US010927653B2

(12) United States Patent
Brown et al.

(10) Patent No.: US 10,927,653 B2
(45) Date of Patent: Feb. 23, 2021

(54) APPARATUS, SYSTEM AND METHOD FOR FLOW RATE HARMONIZATION IN ELECTRIC SUBMERSIBLE PUMP GAS SEPARATORS

(71) Applicant: Halliburton Energy Services, Inc., Houston, TX (US)

(72) Inventors: Donn J. Brown, Broken Arrow, OK (US); Thomas John Gottschalk, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/413,156

(22) Filed: May 15, 2019

(65) Prior Publication Data

US 2019/0264551 A1 Aug. 29, 2019

Related U.S. Application Data

(63) Continuation of application No. 16/346,832, filed as application No. PCT/US2018/020716 on Mar. 2, 2018.

(Continued)

(51) Int. Cl.
*E21B 43/38* (2006.01)
*E21B 43/12* (2006.01)
(Continued)

(52) U.S. Cl.
CPC ..... *E21B 43/128* (2013.01); *E21B 43/38* (2013.01); *F04D 9/003* (2013.01); *F04D 13/10* (2013.01)

(58) Field of Classification Search
CPC ..... E21B 43/128; E21B 43/38
(Continued)

(56) References Cited

U.S. PATENT DOCUMENTS 4,481,020 A 11/1984 Lee et al.
2010/0258306 A1 10/2010 Camilleri et al.
(Continued)

FOREIGN PATENT DOCUMENTS

EP 0437070 B1 3/1994

OTHER PUBLICATIONS

International Search Report and Written Opinion dated Jun. 15, 2018; International PCT Application No. PCT/US2018/020716.

*Primary Examiner* — Taras P Bemko
(74) *Attorney, Agent, or Firm* — McGuireWoods, LLP

(57) ABSTRACT

An apparatus, system and method for flow rate harmonization in electric submersible pump (ESP) gas separators. A method for flow rate harmonization in ESP gas separators includes modifying flow of multi-phase well fluid through vent passages of a crossover when a flow rate of a centrifugal pump differs from a flow rate of a gas separator including the crossover, the gas separator serving as the fluid intake into the centrifugal pump. Flow of fluid through vent passages is modified by one of attaching flow sizing inserts into vent passages or production passages of the crossover, or by attaching a funnel to a crossover inlet. A gas separator system includes a series of interchangeable funnels attachable to a fluid entrance of a crossover of the gas separator, wherein interchanging the particular funnel attached to the crossover modifies flow rate output of the gas separator.

20 Claims, 15 Drawing Sheets

Related U.S. Application Data

(60) Provisional application No. 62/470,022, filed on Mar. 10, 2017.

(51) Int. Cl.
*F04D 9/00* (2006.01)
*F04D 13/10* (2006.01)

(58) Field of Classification Search
USPC ..... 166/105.5
See application file for complete search history.

(56) References Cited

U.S. PATENT DOCUMENTS

| | | | | |
|---|---|---|---|---|
| 2013/0048035 | A1 | 2/2013 | Doi et al. | |
| 2013/0284423 | A1* | 10/2013 | Morrison | E21B 43/38 166/105.5 |
| 2016/0201444 | A1 | 7/2016 | Hardee et al. | |
| 2016/0222773 | A1 | 8/2016 | Sims et al. | |

* cited by examiner

FLOW RATE HARMONIZATION METHOD FOR ELECTRICAL SUBMERSIBLE PUMP GAS SEPARATOR

APPARATUS, SYSTEM AND METHOD FOR FLOW RATE HARMONIZATION IN ELECTRIC SUBMERSIBLE PUMP GAS SEPARATORS

CROSS REFERENCE TO RELATED APPLICATIONS

This application is a continuation of U.S. patent application Ser. No. 16/346,832 filed May 1, 2019, which is a 371 application and claims the benefit of International Application No. PCT/US2018/020716 filed Mar. 2, 2018, which claimed the benefit of U.S. Patent Application No. 62/470,022, filed Mar. 10, 2017. All of the above-mentioned applications are incorporated by reference in the present application.

BACKGROUND

1. Field of the Invention

Embodiments of the invention described herein pertain to the field of electric submersible pumps. More particularly, but not by way of limitation, one or more embodiments of the invention enable an apparatus, system and method for flow rate harmonization in electric submersible pump gas separators.

2. Description of the Related Art

Fluid, such as gas, oil or water, is often located in underground formations. When pressure within the well is not enough to force fluid out of the well, the fluid must be pumped to the surface so that it can be collected, separated, refined, distributed and/or sold. Centrifugal pumps are typically used in electric submersible pump (ESP) applications for lifting well fluid to the surface. Centrifugal pumps impart energy to a fluid by accelerating the fluid through a rotating impeller paired with a stationary diffuser, together referred to as a "stage." Multistage centrifugal pumps use several stages of impeller and diffuser pairs to further increase the pressure lift.

Many underground formations contain fluid that includes both gas and liquid. However, centrifugal pumps are designed to handle fluid consisting mainly of liquids. When pumping gas laden fluid using a centrifugal pump, the gas may separate from the liquid due to the pressure differential created across the pump stage during operation. The separated gas forms bubbles in the liquid. If there is a sufficiently high gas volume fraction (GVF), typically around 10% to 15%, the pump may experience a decrease in efficiency and decrease in capacity or head (slipping). If gas continues to accumulate on the suction side of the impeller, gas bubbles may entirely block the passage of other fluid through the impeller. When this occurs the pump is said to be "gas locked" since proper operation of the pump is impeded by the accumulation of gas.

Conventionally, ESPs sometimes include a gas separator attached below the centrifugal pump, in an attempt to separate gas out of the multi-phase fluid before the gas reaches the pump. In such instances, the gas separator serves as the intake for fluid into the centrifugal pump. The two most common types of gas separator are vortex type and rotary type separators. These separators spin the fluid in a separation chamber to force heavier liquid outward, while gas remains inward near the shaft of the gas separator. Once the fluid is separated, a crossover vents the gas to the casing annulus surrounding the ESP assembly, while the separated liquid continues on to the centrifugal pump.

A problem that arises with conventional gas separators is that their operational flow rates can differ from the flow rate of the attached pump. Conventional centrifugal pumps should operate near a best efficiency point (BEP) for the pump, and pump flow rates vary dramatically for a given casing diameter. For example, in a four-inch casing diameter, a pump may have a BEP flow rate of anywhere from 200 to 7,000 barrels per day (bpd). On the other hand, conventional gas separators only have two flow rate outputs for a given casing diameter, standard or "high volume." In a 4 inch casing diameter, for example, a gas separator may have a standard output of 2,500 bpd and "high volume" output of 6,000 bpd. The result is a mismatch between an ESP's centrifugal pump flow rate and the flow rate of its attached gas separator. Since the gas separator serves as the intake for the centrifugal pump, the mismatch causes turbulence and pump inefficiencies during operation. In instances where the gas separator's flow rate is considerably greater than the flow rate of the pump, the excess fluid can cause turbulence in the separation chamber of the gas separator. Because of the turbulence, excessive amounts of gas may also travel into the pump, rather than being separated and directed to the casing annulus, leading to detrimental effects on the pump.

As is apparent from the above, currently available gas separators suffer from inefficiencies due to flow rate mismatch with centrifugal pumps pumping multi-phase fluid. Therefore, there is need for an apparatus, system and method for flow rate harmonization in electric submersible pump gas separators.

SUMMARY

One or more embodiments of the invention enable an apparatus, system and method for flow rate harmonization in electric submersible pump gas separators.

An apparatus, system and method for flow rate harmonization in electric submersible pump gas separators is described. An illustrative embodiment of a system for flow rate harmonization in electric submersible pump gas separators includes a series of interchangeable funnels attachable to a fluid entrance of a crossover of the ESP gas separator, each funnel of the series of interchangeable funnels having a distinctly sized inner diameter, the inner diameter of a particular funnel of the series of interchangeable funnels determining an inlet area of a vent passage of the crossover when the particular funnel is attached to the fluid entrance of the crossover, and wherein interchanging the particular funnel attached to the crossover modifies flow rate output of the gas separator. In certain embodiments, the ESP gas separator serves as an intake for the centrifugal pump. In some embodiments, the inner diameter of the particular funnel attached to the fluid entrance increases as a flow rate of the centrifugal pump decreases. In certain embodiments, each funnel includes a cylindrical portion defining the inlet area of the funnel, and a conical portion extending from the cylindrical portion to a fluid outlet of the funnel, the fluid outlet attachable to the crossover. In some embodiments, the fluid outlet is threadably attachable to the crossover. In certain embodiments, the conical portion is a conical frustum shape. In some embodiments, an outer diameter of the particular funnel determines an inlet area of a production passage of the crossover when the particular funnel is attached to the fluid entrance of the crossover. In certain embodiments, the production passage is fluidly coupled to a centrifugal pump. In some embodiments, the vent passage extends through the crossover to a casing annulus.

An illustrative embodiment of an electrical submersible pump (ESP) gas separator includes a crossover including a vent passage fluidly coupled to a casing annulus and a production passage fluidly coupled to a centrifugal pump, a fluid entrance of the vent passage inward of a fluid entrance to the production passage, and the fluid entrance of the vent passage separated from the fluid entrance of the production passage by a crossover skirt, and a flow rate harmonization conduit, the flow rate harmonization conduit including an inlet area formed by an inner diameter of the flow rate harmonization conduit, and an outlet attachable to the skirt such that when the flow rate harmonization conduit is attached to the skirt, a size of the fluid entrance to the vent passage is defined by the inlet area of the flow rate harmonization conduit, and a size of the fluid entrance to the production passage is defined by an outer diameter of the flow rate harmonization conduit. In certain embodiments, the flow rate harmonization conduit is one of a series of flow rate harmonization conduits attachable to the skirt, the inlet area of each conduit of the series flow rate harmonization conduits distinct from other flow rate harmonization conduits in the series. In some embodiments, attachment of a particular flow rate harmonization conduit from the series of flow rate harmonization conduits determines flow rate of fluid into the centrifugal pump based on the inlet area of the particular flow rate harmonization conduit attached. In certain embodiments, the flow rate harmonization conduit is funnel shaped and includes a cylindrical portion having a diameter that defines the inlet area of the flow rate harmonization conduit, and a conical frustum shaped portion coupled to the cylindrical portion, the conical frustum shaped portion including the outlet attachable to the skirt.

An illustrative embodiment of a method flow rate harmonization in electric submersible pump gas separators includes identifying differences between a flow rate of a centrifugal pump and a flow rate of an attached gas separator that serves as an intake of the centrifugal pump, selecting a funnel having a particularly sized inlet area based on the flow rate difference so identified, and fastening the funnel so selected to a crossover inlet of the attached gas separator, wherein the funnel modifies a proportion of fluid entering the gas separator that vents to an annulus casing. In some embodiments, the funnel is at least partially conical frustum shaped. In certain embodiments, the particularly sized inlet area of the funnel so selected increases as the flow rate difference increases. In some embodiments, selecting the funnel of the particularly sized inlet area further includes increasing the particularly sized inlet area dictated by the flow rate difference when gas volume fraction of well fluid in a well where the centrifugal pump is to be deployed exceeds a threshold. In certain embodiments, identifying differences between the flow rate of the centrifugal pump and the flow rate of the attached gas separator includes identifying a best efficiency flow rate of the centrifugal pump and identifying a flow rate of the attached gas separator, and wherein selecting the funnel of the particularly sized inlet area includes consulting a funnel size selection table.

An illustrative embodiment of a method for flow rate harmonization in electric submersible pump gas separators includes determining a flow rate of a gas separator to select a funnel size selection table, identifying a best efficiency point (BEP) flow rate of a centrifugal pump to be attached to the gas separator, consulting the funnel size selection table to correlate a funnel size to the BEP flow rate so identified, and attaching a funnel having the correlated funnel size to a skirt of a crossover of the gas separator. In some embodiments, the flow rate harmonization method further includes deploying the centrifugal pump with gas separator attached downhole in a production well. In certain embodiments, the funnel size selection table correlates a first funnel size to the BEP flow rate when a gas volume fraction of fluid to be pumped by the centrifugal pump is below a threshold, and correlates a second funnel size to the BEP flow rate when the gas volume fraction is above the threshold. In certain embodiments, the funnel is at least partially conical frustum-shaped. In some embodiments, attaching the funnel to the skirt of the crossover includes brazing the funnel to the skirt. In certain embodiments, attaching the funnel to the skirt of the gas separator includes threading the funnel to the skirt.

An illustrative embodiment of an electric submersible pump (ESP) gas separator, includes a crossover including a vent passage fluidly coupled to a casing annulus and a production passage fluidly coupled to a centrifugal pump, and a flow sizing insert attached within one of the production passage or the vent passage. In certain embodiments, the flow sizing insert includes a hollow cylinder that narrows the one of the production passage or the vent passage. In certain embodiments, the flow sizing insert includes a nozzle that modifies a width of the one of the production passage or the vent passage. In certain embodiments, the ESP gas separator further includes a snap ring attaching the flow sizing insert within the one of the production passage or the vent passage. In certain embodiments, a wall of the one of the production passage or the vent passage includes threads, and the flow sizing insert includes outer diameter threads that mate with the passage threads. In some embodiments, there are a plurality of the one of the production passage or the vent passage, and a plurality of the flow sizing inserts, wherein at least one flow sizing insert is attached within each of the one of the production passage or the vent passage. In some embodiments, the ESP gas separator further includes a centrifugal pump attached downstream of the crossover, wherein the centrifugal pump has a flow rate of at least 4,000 barrels per day and the flow sizing insert is attached within the vent passage. In certain embodiments, the ESP gas separator further includes a centrifugal pump attached downstream of the crossover, wherein the centrifugal pump has a flow rate of less than 4,000 barrels per day and the flow sizing insert is attached within the production passage.

An illustrative embodiment of a method for flow rate harmonization in electric submersible pump gas separators includes identifying differences between a flow rate of a centrifugal pump and a flow rate of an attached gas separator, selecting one of a vent passage or a production passage for flow restriction based on the flow rate difference so identified, and installing a flow sizing insert into the one of the vent passage or the production passage so selected. In some embodiments, the flow rate optimization method further includes operating the centrifugal pump with the installed flow sizing insert.

A method for flow rate harmonization in electric submersible pump gas separators includes modifying flow of multi-phase well fluid through vent passages of a crossover when a flow rate of a centrifugal pump differs from a flow rate of a gas separator including the crossover, the gas separator attached to the centrifugal pump and serving as the fluid intake into the centrifugal pump. In certain embodiments, the flow of multi-phase well fluid through the vent passages is modified by attaching a funnel to a crossover inlet, and the vent passages vent to a casing annulus. In some embodiments, the flow of multi-phase well fluid is modified by attaching flow sizing inserts into one of the crossover vent passages or production passages of the crossover, wherein the crossover vent passages fluidly couple to a casing annulus and the production passages fluidly couple to the centrifugal pump.

In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

Advantages of the present invention may become apparent to those skilled in the art with the benefit of the following detailed description and upon reference to the accompanying drawings in which.

Figure 1:
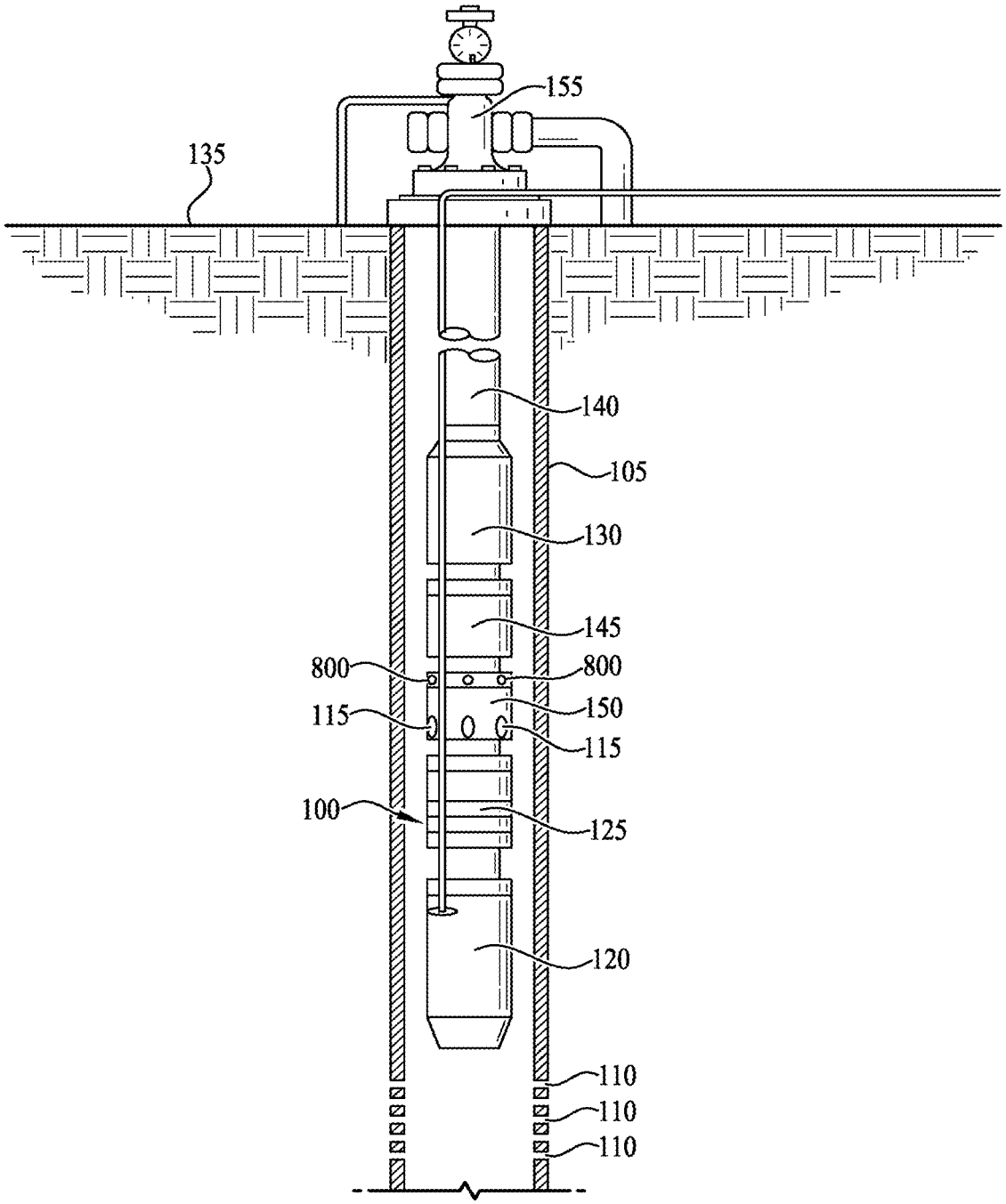
FIG. 1 is a perspective view of an electric submersible pump (ESP) assembly of an illustrative embodiment.

While the invention is susceptible to various modifications and alternative forms, specific embodiments thereof are shown by way of example in the drawings and may herein be described in detail. The drawings may not be to scale. It should be understood, however, that the embodiments described herein and shown in the drawings are not intended to limit the invention to the particular form disclosed, but on the contrary, the intention is to cover all modifications, equivalents and alternatives falling within the scope of the present invention as defined by the appended claims.

DETAILED DESCRIPTION

An apparatus, system and method for flow rate harmonization in electric submersible pump gas separators is described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As used in this specification and the appended claims, the singular forms "a", "an" and "the" include plural referents unless the context clearly dictates otherwise. Thus, for example, reference to a "passage" includes one or more passages.

"Coupled" refers to either a direct connection or an indirect connection (e.g., at least one intervening connection) between one or more objects or components. The phrase "directly attached" means a direct connection between objects or components.

As used herein the terms "axial", "axially", "longitudinal" and "longitudinally" refer interchangeably to the direction extending along the length of the shaft of an ESP assembly component such as an ESP intake, multi-stage centrifugal pump, seal section, gas separator or charge pump.

"Downstream" refers to the longitudinal direction substantially with the principal flow of lifted fluid when the pump assembly is in operation. By way of example but not limitation, in a vertical downhole ESP assembly, the downstream direction may be through the well towards the wellhead. The "top" of an element refers to the side of an element that would be the downstream-most side of the element when the element is positioned within the well.

"Upstream" refers to the longitudinal direction substantially opposite the principal flow of lifted fluid when the pump assembly is in operation. By way of example but not limitation, in a vertical downhole ESP assembly, the upstream direction may be through the well away from the wellhead. The "bottom" of an element refers to the side of thet element that would be the upstream-most side of the element when the element is positioned within the well.

For ease of description, illustrative embodiments described herein are in terms of a downhole ESP assembly having a vortex type gas separator. As may be appreciated by those of skill in the art, the flow rate harmonization funnels of illustrative embodiments may be equally applied to gas separators of the rotary type by modifying the attachment mechanism between the funnel and the gas separator. In rotary type gas separator embodiments, the funnel attachment may fit around, above and/or over the paddle of the rotary. Illustrative embodiments may be applied to any centrifugal pump lifting multi-phase fluid and/or other types of pumps making use of gas separators as the pump intake.

Illustrative embodiments may allow flow rate harmonization between a centrifugal pump and a gas separator serving as the intake of the centrifugal pump despite variations between the operational flow rate of the pump and gas separator respectively. The gas separator of illustrative embodiments may reduce the likelihood of gas separator overflow by selectively venting fluid to the casing annulus. The portion of fluid sent to the centrifugal pump may be selected to have reduced gas content, and as a result may reduce the likelihood of gas lock and/or other gas-induced damage to the assembly. Illustrative embodiments may decrease fluid flow turbulence and prevent and/or reduce gas separator overflow. Illustrative embodiments may provide a gas separator compatible with a wider range of pumps and/or pump flow rates than conventional gas separators.

A method for flow rate harmonization in ESP gas separators includes selectively modifying flow of multi-phase well fluid through crossover vent passages, crossover production passages or both, based on identified differences between a flow rate of a centrifugal pump and a flow rate of an attached gas separator. Flow modification may be employed by one of a series of interchangeable funnels attached to the intake of the crossover of the gas separator and/or by flow sizing inserts secured within vent passages or production passages of the gas separator.

A gas separator of illustrative embodiments may include a selected funnel from a series of funnels, which funnels may interchangeably couple to a crossover of the gas separator. The funnels may be flow rate harmonization funnels and/or flow sizing funnels, with each funnel having a distinct inlet area that modifies the flow rate of fluid through production and vent pathways of the crossover. In this way, the funnels of illustrative embodiments may allow a gas separator to redirect an optimal flow rate of higher-density, gas poor fluid to the pump while venting the remaining lower-density, gas rich fluid into the casing annulus. The rate of fluid continuing from the gas separator to the pump may thus be harmonized with the pump's flow rate by including at the crossover fluid entrance a funnel having an inlet area that best matches the operational and/or best efficiency point (BEP) flow rate of the pump. A funnel of a particular size, selected from a set of funnels, may be attached as needed in order to harmonize flow rate of a gas separator with the flow rate of a particular pump to which it is attached. By interchanging funnels of distinct inlet area, illustrative embodiments may provide a gas separator capable of adapting to different pumps, pump flow rates, casing diameters and/or well fluid content while reducing flow inefficiencies and decreasing the likelihood of gas lock in the pump.

In some embodiments, rather than or in addition to funnels, a gas separator may include flow sizing inserts selectively placed within vent passages or production passages of the gas separator to harmonize flow rate between an ESP pump and its attached gas separator. The flow sizing inserts may balance flow of multi-phase fluid flowing through gas separator vent passages and production passages respectively to harmonize flow rate between the gas separator and an attached pump.

Illustrative embodiments may include an artificial lift assembly, such as an ESP assembly, which may be located downhole below the surface of the ground. FIG. 1 shows an exemplary ESP assembly 100. ESP assembly 100 may be positioned within well casing 105, which may separate ESP assembly 100 from an underground formation. Well fluid may enter casing 105 through perforations 110 and travel downstream inside casing 105 to intake ports 115. Intake ports 115 may serve as the intake for ESP pump 130 and may be located on an ESP intake section or may be integral to gas separator 150. Gas separator 150 may be a vortex or rotary separator and may separate at least a portion of gas from the well fluid before the fluid enters ESP pump 130. Motor 120 may be an electric submersible motor that operates to turn ESP pump 130 and may, for example, be a two-pole, three-phase squirrel cage induction motor. Seal section 125 may be a motor protector, serving to equalize pressure and keep motor oil separate from well fluid. ESP Pump 130 may be a multi-stage centrifugal pump with stacked impeller and diffuser stages, and may lift fluid to surface 135. Production tubing 140 may carry pumped fluid to wellhead 155 and/or surface 135, and then into a pipeline, storage tank, transportation vehicle and/or other storage, distribution or transportation means. In gassy wells, charge pump 145 may be employed as a lower tandem pump to boost fluid before it enters production pump 130. Charge pump 145 may reduce the net positive suction head required, allowing ESP production pump 130 to operate in low inflow pressure conditions that may be caused by gas ingress.

Figure 2:
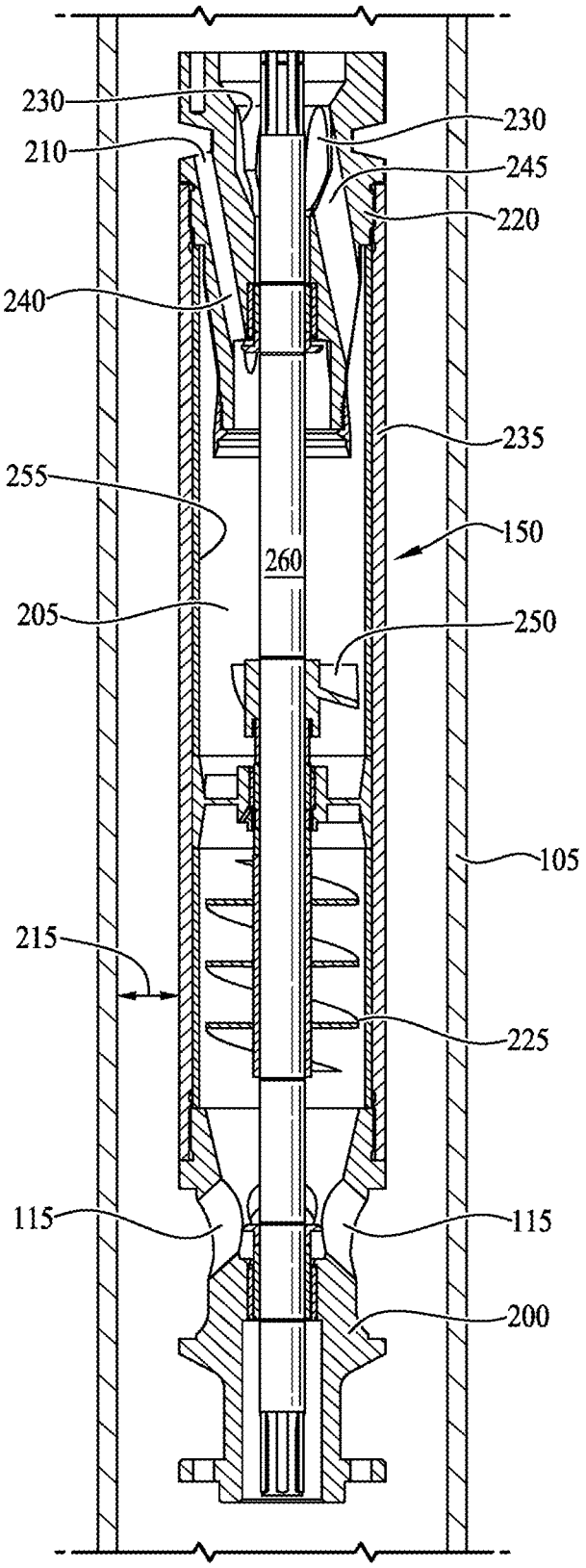
FIG. 2 is a cross-sectional view of a gas separator of an illustrative embodiment.

Turning to FIG. 2, gas separator 150 may include intake section 200 where multi-phase fluid enters gas separator 150 from casing annulus 215, separation chamber 205 where higher-density, gas poor fluid may be separated from lower-density, gas rich fluid, and crossover 220 where higher-density fluid may be sent to centrifugal pump 130 and lower-density fluid may be vented back to casing annulus 215. Intake ports 115 may be spaced circumferentially around intake section 200 and serve as the intake for fluid into ESP assembly 100 and/or centrifugal pump 130. Vent ports 210 may be spaced around crossover 220 and may allow lower-density fluid to exit gas separator 150 and vent into casing annulus 215. Shaft 260 may be rotated by ESP motor 120 (either directly or via the intervening shaft of seal section 125) and extend longitudinally and centrally through gas separator 150. Housing 235 may separate separation chamber 205 and/or crossover 220 from casing annulus 215. Housing 235 may be a supportive structure that transmits axial loads across gas separator 150. Liner 255 may provide a corrosion resistant lining to housing 235 and/or serve as the outer containment for higher-density fluid entering production passage 245.

Multi-phase well fluid may enter intake ports 115 and travel downstream through separation chamber 205. In separation chamber 205 gas and liquid of the multi-phase fluid may be separated or at least partially separated. Auger 225 may be keyed to gas separator shaft 260 and may impart axial momentum to multi-phase well fluid travelling through separation chamber 205. In vortex type gas separators as shown in FIG. 2, vortex generator 250 may be rotatably keyed to shaft 260 and may whirl and/or swirl fluid moving through separation chamber 205. One or more vortex generators 250 may be included downstream of auger 225. Using rotational momentum, vortex generator 250 may induce lighter-density, gas rich fluid to move inwards towards shaft 260 and higher-density, gas poor fluid to move outward towards liner 255. In some embodiments, gas separator 150 may be a rotary type separator and include a rotary rather than vortex generator 250.

From separation chamber 205, the multi-phase fluid may proceed into passages of crossover 220 where lower-density, gas rich fluid may be vented into casing annulus 215 through vent passage 240, and higher-density, gas poor fluid may continue through production passage 245 and openings 230 to pump 130. Fluid continuing through openings 230 to pump 130 may have a lower GVF than fluid entering intake ports 115. Gas separator 150 may be a standard output gas separator or may have a "high-volume" output.

The inventors have observed that conventional "one-size-fits-all" gas separator designs limit operational flow rates of the pump by overflowing the gas separator and causing turbulence. Illustrative embodiments may reduce the instance of gas separator overflow by harmonizing the flow rates of the pump 130 and its attached gas separator 150. A gas separator 150 of illustrative embodiments may include a series of flow rate harmonization funnels, which funnels may interchangeably attach to crossover 220. The funnels of illustrative embodiments may modify the inlet areas leading to vent passage 240 and production passage 245 respectively, thereby modifying the composition and/or quantity of fluid flowing through the respective flow paths 240, 245 of crossover 220. Each funnel of the series of funnels may have a distinct inlet diameter. Attachment of a funnel with a particular inlet diameter may modify the quantity and/or composition of fluid captured inside the funnel and exiting vent ports 210 based on the inlet diameter selected, and also the volume and composition of fluid flowing outside the funnel that continues to pump 130.

Figure 3:
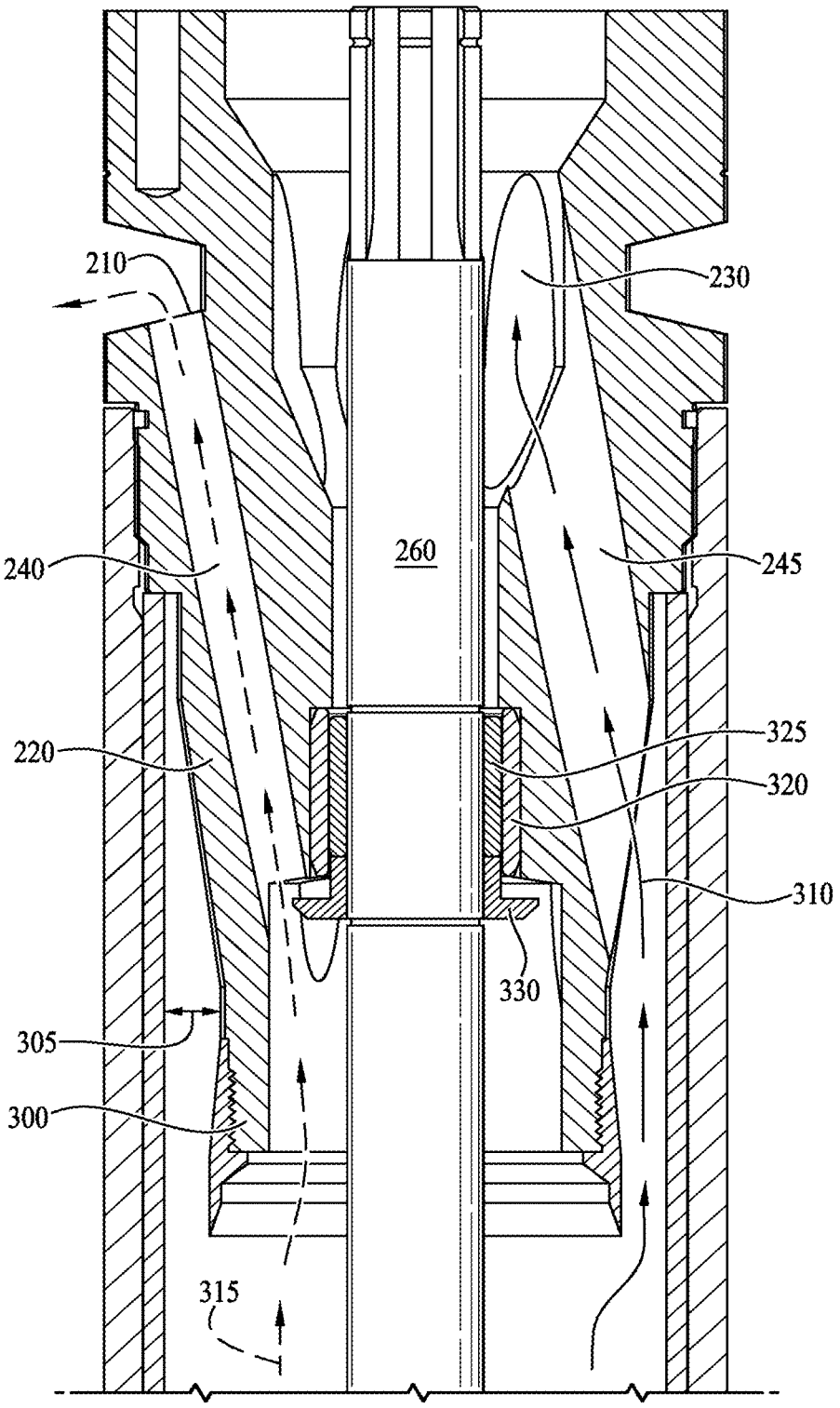
FIG. 3. is a cross-sectional view of a crossover of an illustrative embodiment.

FIG. 3 illustrates a crossover of an illustrative embodiment. Crossover 220 may include skirt 300, which may serve as the entry point for fluid passing through and/or around crossover 220. The inner diameter of skirt 300 may be fluidly coupled to vent passage 240 that extends towards vent ports 210. The space 305 between skirt 300 and liner 255 and/or housing 235 may be fluidly coupled to production passage 245 that extends through crossover 220 and continues towards centrifugal pump 130. Housing 235 may enclose liner 255 and/or crossover 220, providing structural support for gas separator 150 and separation between casing annulus 215 and crossover 220. Housing 235 may include discharge ports 800 (shown in FIG. 8) that align with vent ports 210 of crossover 220. Bearings including bushing 320, sleeve 325 and/or flange 330 may provide thrust and/or radial support to shaft 260. Bushing 320 may be pressed into crossover 220 and remain stationary as sleeve 325 rotates with shaft 260 within bushing 320. Flange 330 may provide thrust support.

During operation, gas separator 150 may induce separation of multiphase fluid into two distinct fluid streams, a first stream that flows through space 305, through production passage 245 and continues on through openings 230 to pump 130, and a second stream that flows through the inner diameter of skirt 300, through vent passage 240 and returns to casing annulus 215 through vent ports 210 and/or discharge ports 800. Higher-density, gas poor fluid 310 may flow through production passage 245 whereas lower-density, gas rich fluid 315 may flow through vent passage 240.

Figure 4A:
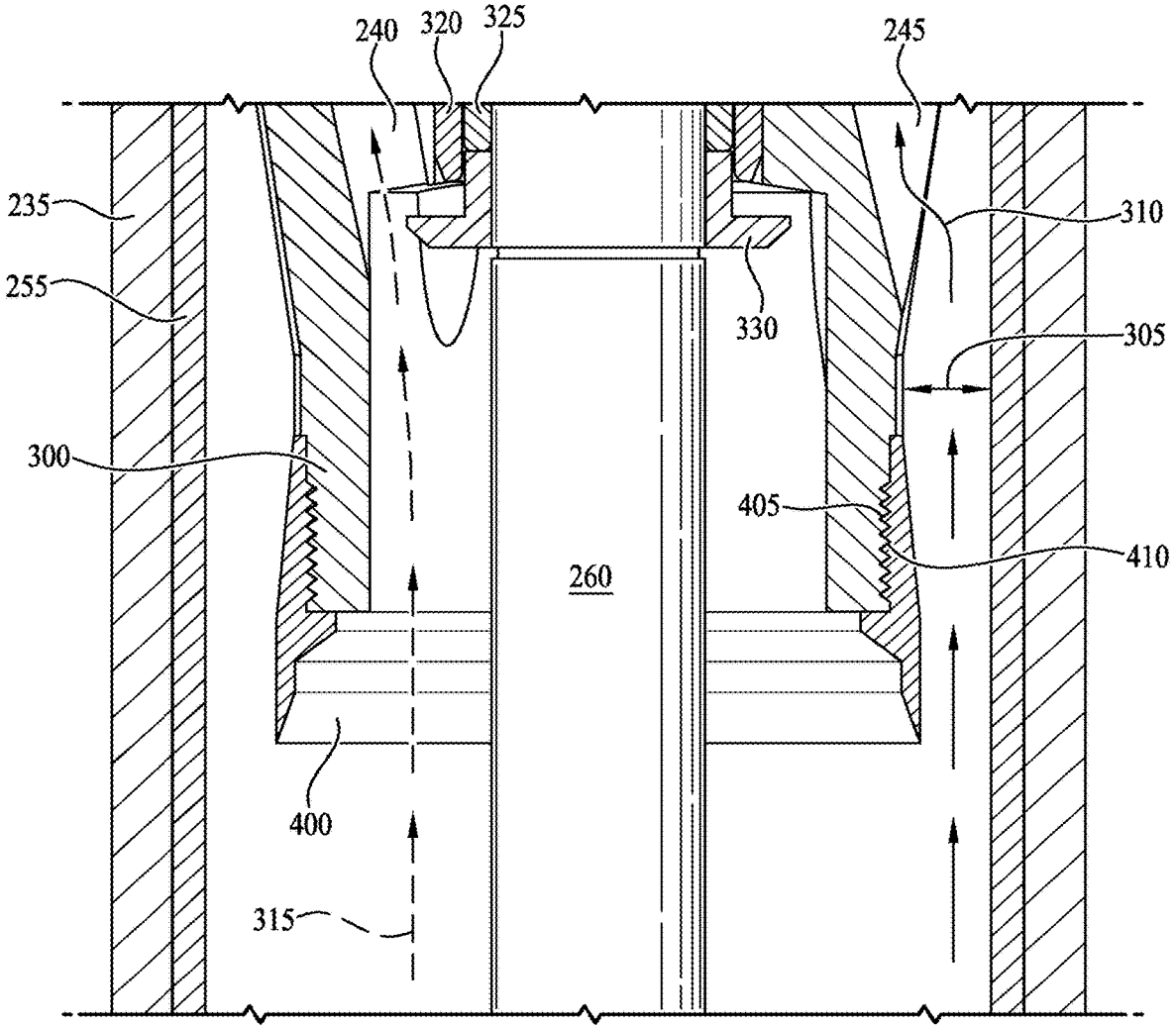
FIG. 4A is a cross-sectional view of a funnel of an illustrative embodiment threadably attached to an outer diameter of a crossover inlet of an illustrative embodiment.
Figure 4B:
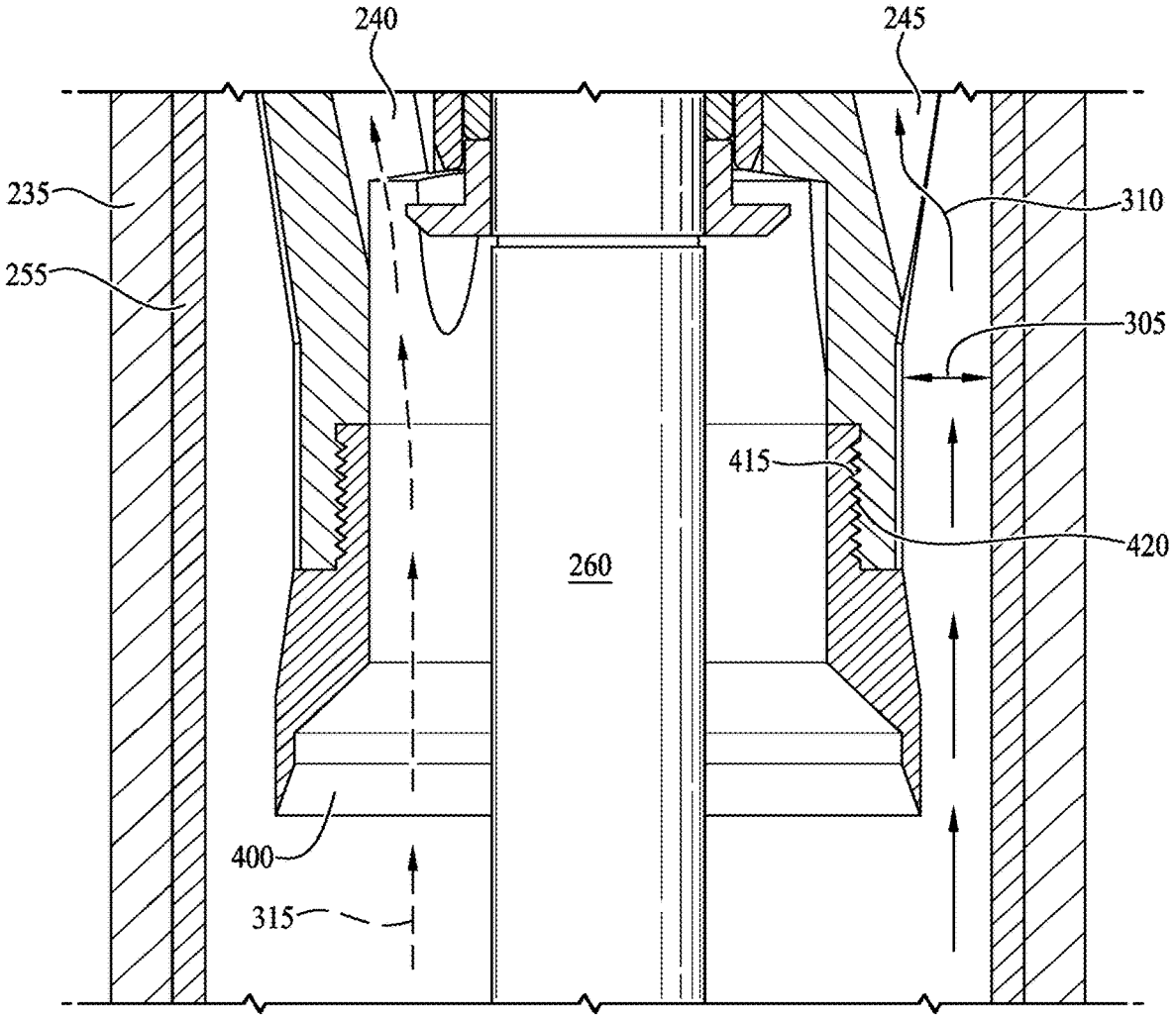
FIG. 4B is a cross-sectional view of a funnel of an illustrative embodiment threadably attached to an inner diameter of a crossover inlet of an illustrative embodiment.

Turning to FIG. 4A and FIG. 4B, funnel 400 may be coupled to the inlet of skirt 300 of crossover 220. When attached, funnel 400 may modify the inlet area leading into crossover passages, thereby altering the proportion of fluid within gas separator 150 that flows through vent passage 240 and production passage 245 respectively. Lower-density, gas rich fluid 315 may tend to be located radially inwards proximate shaft 260 and travel through the inside 900 (shown in FIG. 9) of funnel 400, while higher-density, gas poor fluid 310 may tend to travel radially outwards through space 305. Lower-density, gas rich fluid 315 may be expelled into casing annulus 215 to beneficially remove gas from assembly 100 before such gas reaches centrifugal pump 130. Higher-density, gas poor fluid 310 may flow around the outside of funnel 400 and continue to pump 130 with a lower GVF than fluid entering intake ports 115. Depending on pump 130 flow rate and/or gas content in the well, lower-density, gas rich fluid 315 may vary in volume and/or gas composition. The inlet area 500 (shown in FIG. 5A) and/or diameter D (shown in FIG. 6) of funnel 400 may be selected to direct the appropriate volume of gas rich fluid 315 into casing annulus 215 to harmonize flow rate between gas separator 150 and centrifugal pump 130.

Figure 4C:
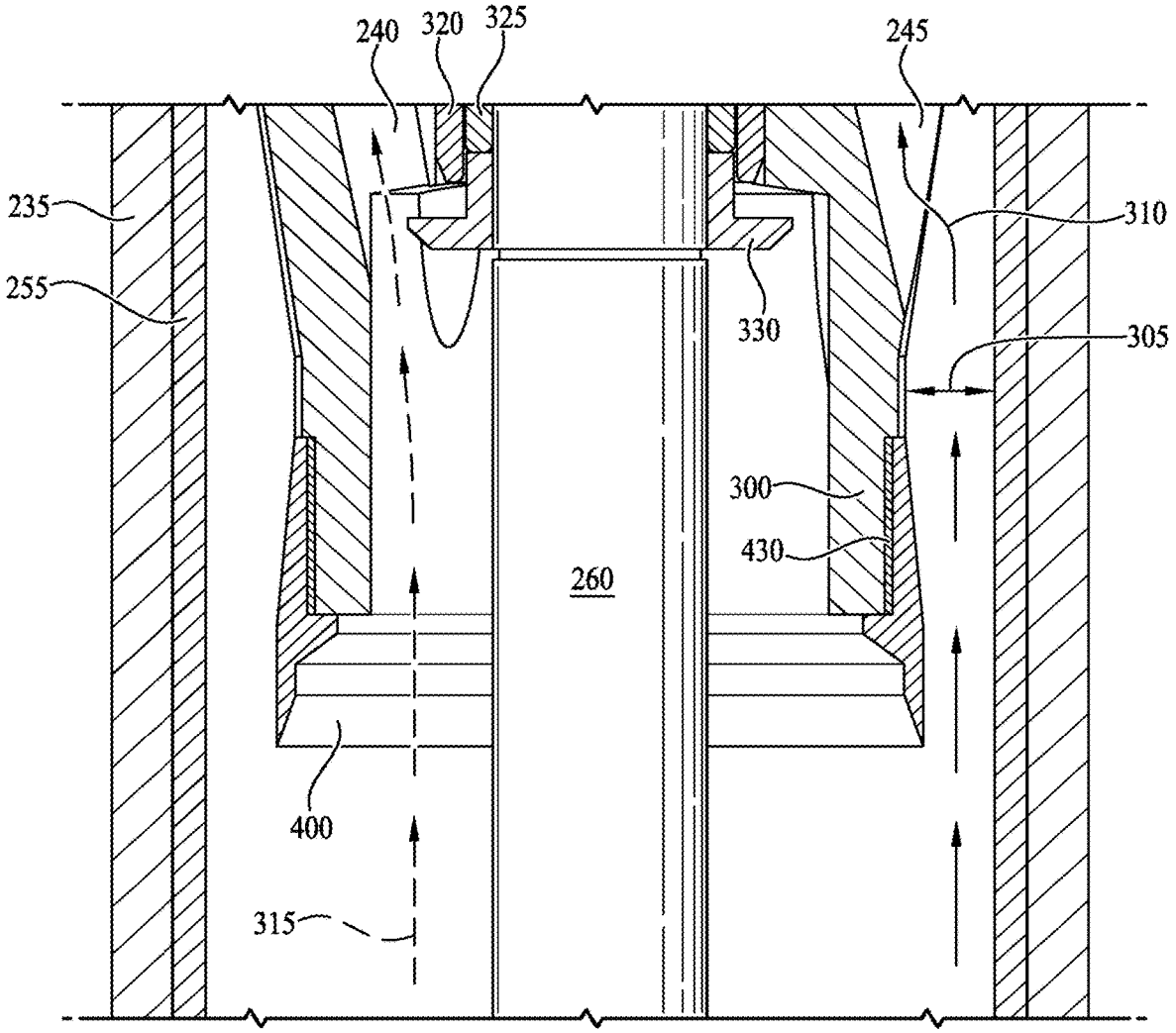
FIG. 4C is a cross-sectional view of a funnel of an illustrative embodiment brazed to a crossover inlet of an illustrative embodiment.

Funnel 400 may be attached to skirt 300 by threading, bolting, friction fit, interference fit, pinning, brazing, welding, gluing, epoxying and/or another similar attachment mechanism. FIGS. 4A and 4B illustrated exemplary threaded attachments. In FIG. 4A, the outside of skirt 300 includes male skirt threads 405 and the inside of funnel 400 includes female funnel threads 410 that mate with male skirt threads 405, such that funnel 400 screws around skirt 300 like a bolt around a screw. In FIG. 4B, the outside of funnel 400 includes male funnel threads 415 and the inside of skirt 300 includes female skirt threads 420 that mate with male funnel threads 415, such that funnel 400 screws inside skirt 300 like a lightbulb screwing into a socket. Funnel 400 may he screwed onto skirt 300 by aligning funnel threads 410 or 415 with skirt threads 405 or 420 respectively and rotating funnel 400 in a first direction. Funnel 400 may be removed and/or disconnected from skirt 300 by rotating funnel 400 in the opposite direction. In some embodiments, funnel 400 may be bolted or interference fit to skirt 300 and/or may be fixedly attached to skirt 300 rather than removeably attached. FIG. 4C illustrates an exemplary brazed attachment. In brazed embodiments, rather than threads, skirt 300 and funnel 400 may have near-mated cylindrical surfaces with braze layer 430 between them.

Figure 5A:
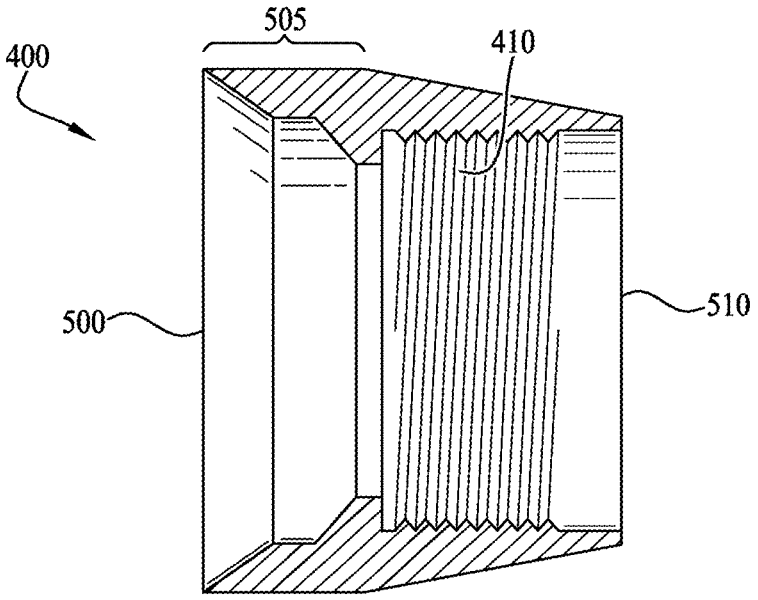
FIG. 5A is a cross sectional view of a funnel of an illustrative embodiment having exemplary inner threads.
Figure 5B:
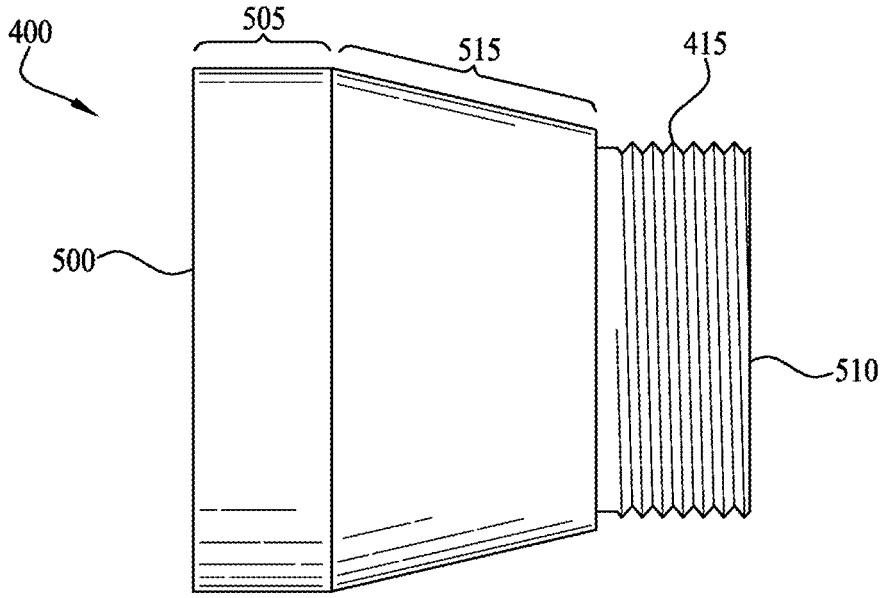
FIG. 5B is a side elevation view of a funnel of an illustrative embodiment having exemplary outer threads.

FIG. 5A and FIG. 5B illustrate exemplary funnels 400 of illustrative embodiments. FIG. 5A illustrates funnel 400 having inner female funnel threads 410. FIG. 5B illustrates funnel 400 having outer male funnel threads 415. Funnel 400 may include cylindrical portion 505 and a sloped cone portion 515 and/or be shaped like a conical frustum, cone, bell, funnel, inverted funnel, lamp shade or another similar shape. Funnel 400 may be one of a series and/or set of funnels 400, each with a distinct inlet area 500 and/or diameter D sized to harmonize varying flow rate differentials between gas separator 150 and centrifugal pump 130. Inlet area 500 may be on the bottom of funnel 400 and serve as the entrance for fluid traveling into funnel 400 and/or skirt 300. Inlet 500 may include cylindrical portion 505 of constant radius to encourage lower-density, gas rich fluid 315, approaching inlet 500 from below funnel 400, to continue inside funnel 400 rather than deflect off a side of funnel 400. The diameter of cylindrical portion 505 may be the same or about the same as the diameter of inlet area 500. Outlet 510 at the top of funnel 400, may attach to skirt 300 such that fluid traveling on the inside 900 of funnel 400 may continue inside skirt 300 through vent passage 240. Sloped portion 515 of funnel 400 may extend between cylindrical portion 505 and outlet 510 and may channel lower-density, gas rich fluid 315 through inside 900 of funnel 400. Sloped cone portion 515 may encourage laminar flow of gas rich fluid 315 through funnel 400. Sloped cone portion 515 may extend diagonally with constant slope decreasing in diameter towards outlet 510. In some embodiments, sloped portion 515 may be curved like a bell rather than having a constant slope.

Figure 6:
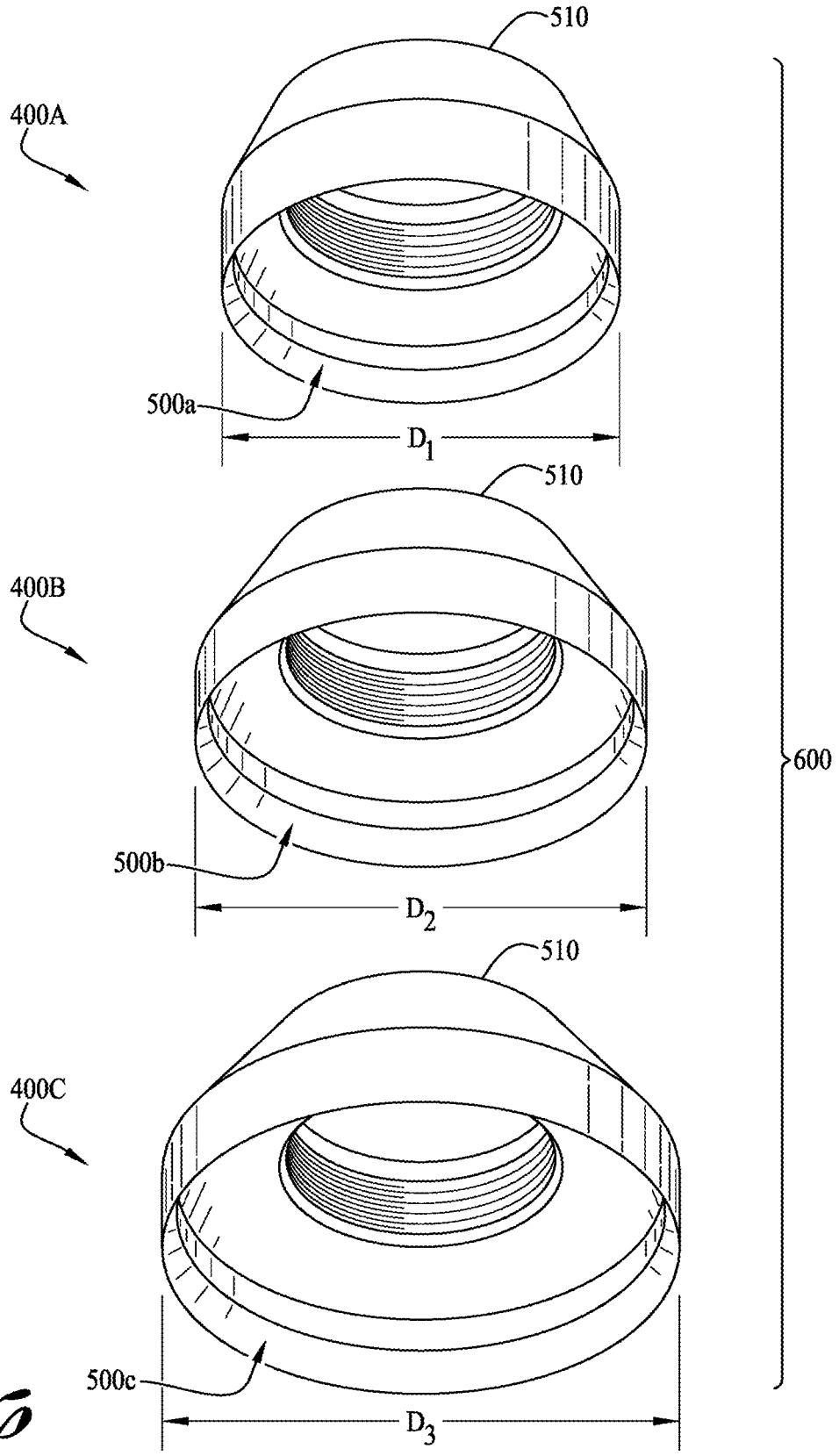
FIG. 6 is a perspective view of a series of funnels of an illustrative embodiment.

FIG. 6 illustrates a series of funnels 400 of an illustrative embodiment. In FIG. 6, three funnels 400 are included in series 600 of funnels 400. In some embodiments, series 600 may include two, three, four or another number of funnels 400. Each funnel 400 may include a distinctly sized inlet area 500 and/or diameter D. Selection of a particular funnel 400 having a particular inlet area 500 and/or diameter D from series 600 may allow the flow rate of gas separator 150 to harmonize with different pumps 130 having distinct flow rate requirements. The outlets 510 of each funnel 400 in series 600 may all be of equal size so as to mate, attach and/or couple with same skirt 300. In the example shown in FIG. 6, three funnels 400A-400C comprise series 600. As shown, each funnel 400 has a distinctly sized inlet area 500*a*-500*c* and diameter D1-D3. Funnel 400A has the smallest inlet area 500*a* and/or diameter D1 of funnels 400 in series 600, and may therefore funnel the least amount of fluid into vent passage 240. Conversely, funnel 400C has the largest inlet area 500*c* and/or diameter D3 of series 600, and may guide the most fluid into vent passage 240. Funnel 400C may therefore be attached to skirt 300 where there is the largest discrepancy between the flow rate of gas separator 150 and the flow rate of pump 130, and where gas separator 150 has a higher flow rate than pump 130. Since outlet 510 of all funnels 400 in series 600 may be of equal size, each funnel 400 having different sized inlets 500 may be used interchangeably on the same skirt 300 of crossover 220, which may allow a single gas separator 150 design to adapt and/or harmonize with a variety of pumps 130 having different BEP flow rates.

Figure 7A:
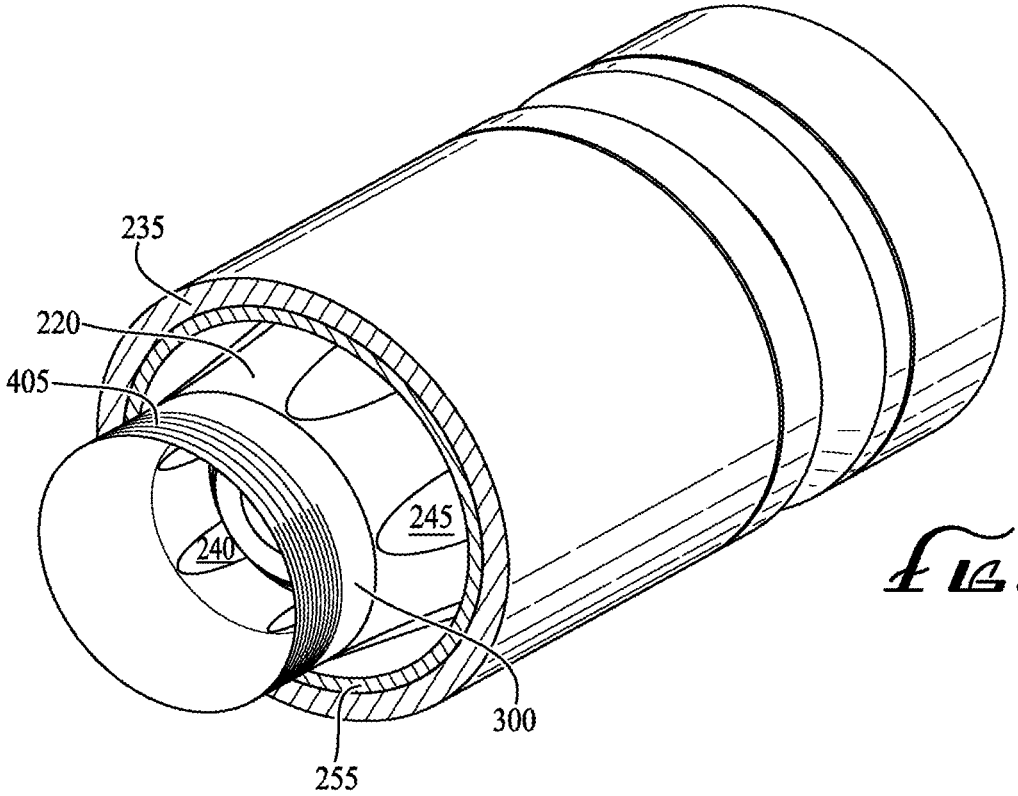
FIG. 7A is a perspective view of a crossover of an illustrative embodiment having outer inlet threads of an illustrative embodiment.
Figure 7B:
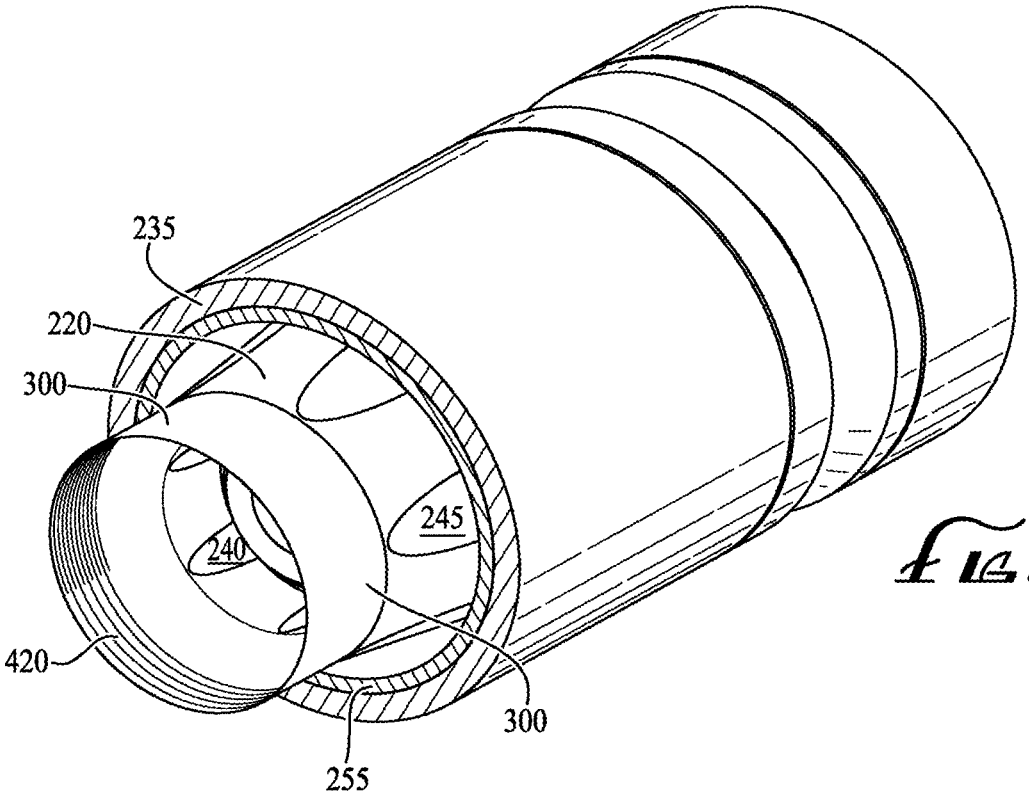
FIG. 7B is a perspective view of a crossover of an illustrative embodiment having inner inlet threads of an illustrative embodiment.
Figure 8:
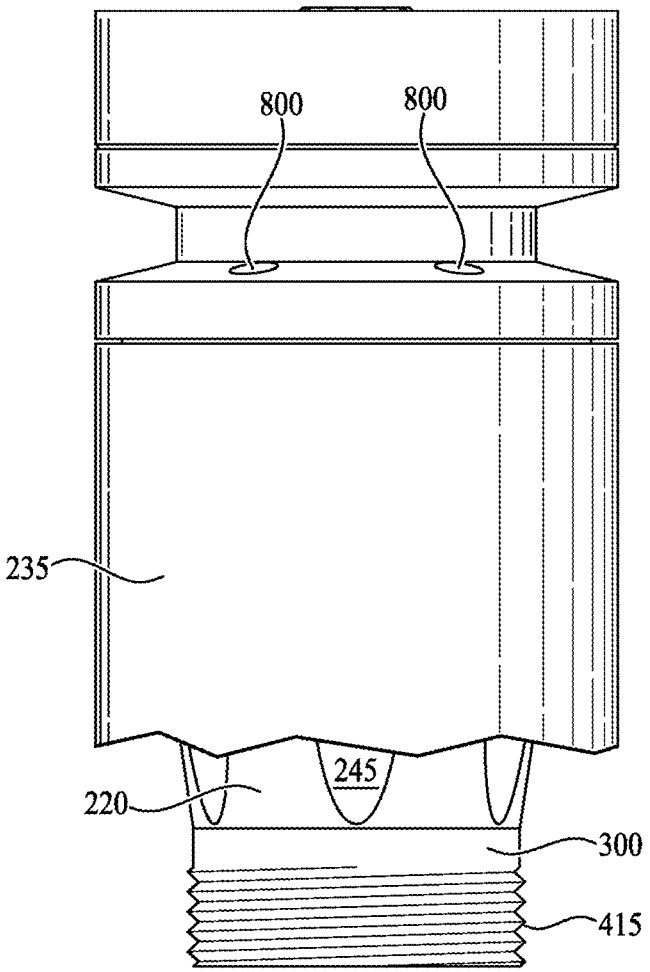
FIG. 8 is side elevation view of a crossover housing of an illustrative embodiment.

FIGS. 7A and 7B show exemplary crossovers of illustrative embodiments. In FIG. 7A, skirt 300 of crossover 220 is shown with outer male skirt threads 405. Crossover 220 of FIG. 7A may mate with funnel 400 of FIG. 5A having inner female funnel threads 410. In FIG. 7B, skirt 300 of crossover 220 is shown with inner female skirt threads 420. Crossover 220 of FIG. 7B may mate with funnel 400 of FIG. 5B having outer male funnel threads 415. FIG. 8 illustrates crossover housing 235, which may include discharge ports 800 that align with vent passage 240 to allow gas rich fluid 315 to vent into casing annulus 215. Housing 235 may attach such as by bolt, screw and/or thread to the housing of assembly 100 components above and below gas separator 150. For example, the top of housing 235 may bolt to pump 130, and bottom of housing 235 may bolt to seal section 125.

Figure 9:
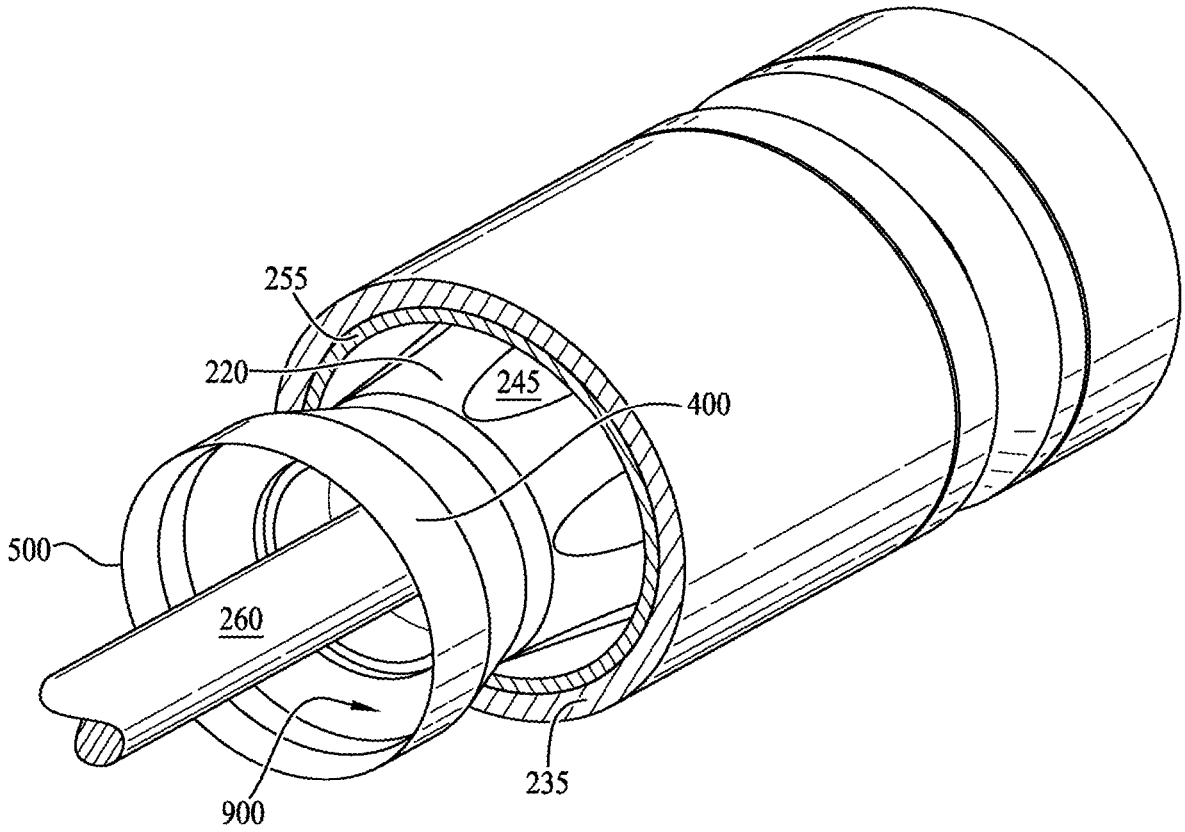
FIG. 9 is a perspective view of a flow rate harmonization system of an illustrative embodiment.

FIG. 9 illustrates crossover 220 with selected funnel 400 attached. When attached, inlet 500 of funnel 400 may face upstream towards separation chamber 205, which may allow funnel 400 to channel gas rich fluid 315 into inside 900 of crossover 220 to vent passage 240. Vortex generator 250 may induce gas rich fluid 315 close to shaft 260 and into inside 900 of funnel 400. Since funnel inlet 500 may have a larger diameter D than skirt 300, funnel 400 may allow more gas rich fluid 315 to travel inside 900 skirt 300 and out of vent ports 210 than would otherwise flow in the absence of funnel 400. Should it be desirable for less fluid to vent to casing annulus 215, a funnel 400 with smaller inlet area 500, no funnel 400 or a funnel 400 with an inlet area 500 smaller than the inner diameter of skirt 300 may be employed. In the latter instance, funnel 400 may be an inverted funnel shape.

In order to harmonize gas separator 150 with pumps 130 having different flow rates, a series 600 of interchangeable funnels 400 having differently sized diameters D and/or inlet areas 500 may be used to vary the amount of fluid that gas separator 150 vents into casing annulus 215. During operation in a well with high gas content and/or fast flow rate, a funnel 400 with a larger inlet 500 and/or diameter D may be used to expel a greater amount of gas rich fluid 315 and deliver an optimal flow rate to pump 130. Alternatively, if a lesser amount of gas rich fluid 315 and/or overflow fluid is present, a funnel 400 having a smaller inlet 500 and/or diameter D may be used in order to expel less fluid and deliver more liquid to pump 130. In the case that pump 130 is operating with a flow rate that matches or substantially matches the output of gas separator 150, funnel 400 may be omitted from skirt 300. Each funnel 400 of series 600 may have a distinct inlet area 500 and/or a distinct diameter D, different from that of the other funnels 400 in the series 600 of funnels 400. In this way, the volume of fluid directed towards vent ports 210 on the one hand, and towards pump 130 on the other hand, may be customized based on the size of funnel 400 selected for attachment to skirt 300. By adapting the rate at which fluid is sent to pump 130 and casing annulus 215, respectively, a larger range of flow rates of pump 130, pump types, and/or well conditions such as casing 105 size and gas content may be accommodated with a single "one size fits all" gas separator 150 design. Gas separator type, pump flow rate and anticipated GVF may be the factors used to determine a suitably-sized funnel 400. Such determining factors may be compiled and/or tabulated in order to allow the optimum funnel 400 size to be identified and installed prior to setting ESP assembly 100 in the well.

Table 1 illustrates an exemplary funnel selection table of an illustrative embodiment. In a funnel selection table of illustrative embodiments, a series 600 of funnels 400 having specified inlet diameters D and/or inlet areas 500 may be matched with corresponding pump flow rate values to form a combination that may harmonize the flow rate of gas separator 150 with pump 130. A funnel 400 selection table may be created for each type of gas separator 150 that may be employed in illustrative embodiments. Values allocated in the funnel 400 selection tables of illustrative embodiments may be determined based on laboratory testing of performance of a series 600 of particularly sized and shaped funnels 400 in conjunction with a particular gas separator 150 design and a particular pump 130.

TABLE 1

Exemplary Funnel Size Selection Table for Gas Separator Flow Rate of 2,500 bpd

| Funnel if GVF above 60% Threshold | Funnel if GVF below 60% Threshold | Inlet Diameter (cm) | Pump Flow Rate (BEP) |
|---|---|---|---|
| 400C | 400C | 7.620 | 300-1000 bpd |
| 400C | 400B | 6.668 | 1000-2300 bpd |
| 400B | 400A | 5.398 | 2300-4000 bpd |
| 400A | No Funnel | 4.445 (ID 300 of skirt) | 4000 bpd and Above |

As shown in Table 1, exemplary sizes of funnel 400 are assigned corresponding flow rates for a pump 130 operating at 60 Hz and a gas separator 150 having a flow rate of 2,500 bpd. Particular funnel 400 sizes included in Table 1may be determined based on funnel 400 shape and the type of gas separator 150 and pump 130 employed. When using one or more tables of illustrative embodiments, a particular funnel 400 having the diameter D specified may be selected when the BEP flow rate of centrifugal pump 130 falls within the range specified in the corresponding row of Table 1. For purposes of Table 1, the flow rate of pump 130 may be based on a manufacturer test curve and/or pump testing. In some embodiments, a particular funnel 400 having diameter D may be selected and attached to gas separator 150 solely based on pump 130 BEP flow rate and gas separator 150 type (e.g., standard or high volume), without regard to GVF or other well conditions. In certain embodiments, once a particularly sized funnel 400 is indicated based on a funnel selection table for the appropriate gas separator 150 design, the funnel 400 size may be adjusted one size large than otherwise indicated by the table if a GVF above a set threshold is anticipated within the applicable well where assembly 100 and/or pump 130 may be deployed.

As illustrated in exemplary Table 1, series 600 of funnels 400 includes three exemplary funnels 400. Each funnel 400 in series 600 of funnels 400A-400C may be matched with a BEP flow rate of centrifugal pump 130. In Table 1, each of the funnels 400A, 400B, and 400C has a uniquely-sized inlet diameter D1, D2 or D3 respectively, which inlet 500 diameter D may complement a specific flow rate of pump 130, in order to harmonize the flow rate of gas separator 150 with the flow rate of pump 130. Inlet diameter D1, D2 and D3 may represent the inner diameter of cylindrical portion 505 of funnel 400. As shown in Table 1, for a pump having a flow rate of 300-1000 bpd, funnel 400C having a diameter of 3.000 inches (7.620 cm) may be attached to gas separator 150 of 2,500 bpd output. Funnel 400C may be appropriate for pumps 130 with the lowest flow rates because the inlet 500 diameter D3 of funnel 400C, which in this example is 3.000 inches (7.620 cm), is the largest of series 600 of funnels 400 and the flow rate of gas separator 150 exceeds that of pump 130 in this example. The slowest flow rate of pump 130 indicated in Table 1 requires the largest amount of fluid sent into casing annulus 215 and thus the largest inlet 500 and/or diameter D leading to vent passage 240, in order to prevent overflow and the associated fluid turbulence. Funnel 400C may allow gas poor fluid 310 to travel to pump 130 with a slower flow rate than without any funnel 400. As those of skill in the art may appreciate, different funnel 400 sizes may be selected in a similar fashion based on flow rates, GVF of well fluid and/or other ambient well conditions.

One or more tables such as the exemplary Table 1 may be provided for different pumps 130, pump flow rates, gas separators 150, gas separator outputs, and/or GVF of the well fluid. Table values may be modified as needed for different funnel 400 shapes and sizes, pump 130 and/or gas separator 150 types. In some embodiments more than three funnels 400 may be included in a table and/or series 600 of funnels 400, and may for example, accommodate smaller increments of pump flow rates than shown in exemplary Table 1.

A method of illustrative embodiments may allow harmonization between flow rates of centrifugal pump 130 and gas separator 150 while reducing the likelihood of gas lock in pump 130. Illustrative embodiments may allow a single "one size fits all" gas separator 150 design to harmonize with various centrifugal pumps 130 that operate with different flow rates and/or differing BEPs. Gas separator 150 of illustrative embodiments may deliver well fluid to pump 130 with a lower GVF despite operating in wells containing varying amounts of gas and flow rates. Illustrative embodiments may reduce and/or prevent flow inefficiencies between pump 130 and an attached gas separator 150, which may decrease flow turbulence and resulting production inefficiencies. Illustrative embodiments may allow a single gas separator 150 to be compatible with a wider range of pumps 130 and/or pump flow rates than conventional gas separators.

Figure 10:
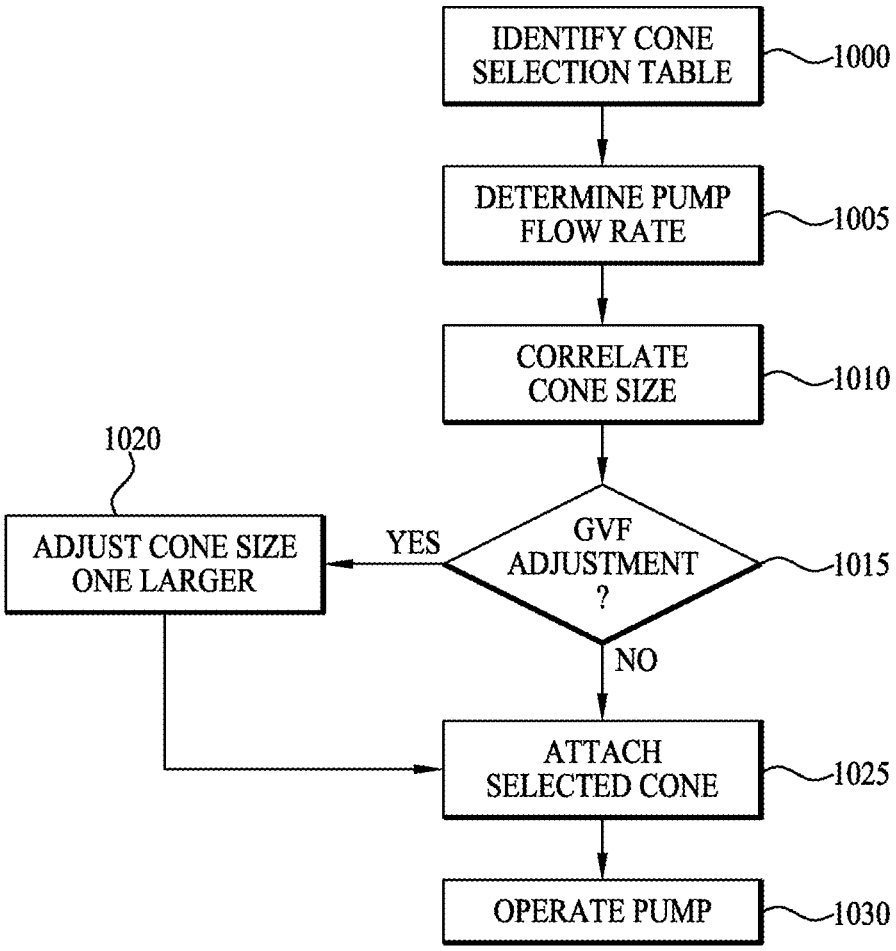
FIG. 10 is a flowchart diagram of an exemplary flow rate harmonization method an illustrative embodiment.

FIG. 10 is a flowchart of an exemplary method for flow rate harmonization between an electric submersible pump 130 and its attached gas separator 150. At identification step 1000, the proper funnel 400 size selection table may be identified. Each funnel 400 selection table may be associated with a particular gas separator 150 design. Thus, the correct table may be located by identifying the gas separator 150 type to be included in assembly 100, and obtaining the associated table. Table values may be pre-tested, pre-calculated and/or pre-populated such that a table is readily available when parts for assembly 100 are ordered and/or assembled. At flow rate determination step 1005, the flow rate of pump 130 may be determined. The flow rate of pump 130 may be a manufacturer-specified BEP flow rate and/or may be an observed BEP flow rate after testing, but prior to deployment of assembly 100.

During funnel correlation step 1010, the identified funnel 400 size selection table may be consulted to select the appropriately sized funnel 400. The identified table may dictate the appropriate funnel 400 diameter D size by locating on the size selection table the determined BEP flow rate of the pump 130 to be included in assembly 100, and selecting the corresponding funnel 400 indicated in the same row of the table. Once a particular funnel 400 has been identified through use of the appropriate table, at step 1015 it may be determined whether a GVF adjustment to the table correlation may be required. For example, if it is anticipated that well fluid where pump 130 will be deployed will have a particularly high GVF, such as 45% or higher, or 60% or higher, or another predetermined GVF threshold, then an adjustment to the table correlation may be made before selecting a particular funnel 400. If the GVF threshold (such as, for example, 45% or 60% GVF) is met, then funnel 400 selected may be a funnel 400 one size larger than otherwise indicated by the funnel selection table and/or, as illustrated in the exemplary Table 1, the funnel selection table may have a distinct funnel identification column for particularly high GVF applications. For example, if Table 1 is consulted for a BEP flow rate of 2,000 bpd, then at funnel correlation step 1010 it would be indicated that funnel 400B should be selected. However, if at GVF adjustment inquiry 1015 if is determined that the GVF of the production well is expected to be sufficiently high, such as for example meeting a predetermined threshold of 60% GVF, then at adjustment step 1020, it may be determined that funnel 400C should be selected rather than funnel 400B due to the anticipated high GVF. In another example, if the determination at funnel size correlation step 1010 indicates the largest funnel 400C should be used, then no larger adjustment may be possible at adjustment step 1020.

Funnel 400 so selected during step 1010 or 1020, as appropriate, may then be installed into gas separator 150 during attachment step 1025. In the case of a threaded connection, funnel 400 may be screwed to skirt 300 of crossover 220 of gas separator 150 by aligning funnel threads 410 or 415 with skirt threads 405 or 420 respectively. The threaded connection may allow funnel 400 to couple to crossover 220 and funnel 400 inside 900 to align with vent passage 240. In this way, funnel inlet 500 may serves as the inlet into vent passage 240 of crossover 220, as described herein. Finally, ESP assembly 100 may be deployed within a well, and operation commenced at operation step 1030. Gas separator 150 may provide centrifugal pump 130 with well fluid with reduced GVF and reduced turbulence during step 1030.

Figure 11A:
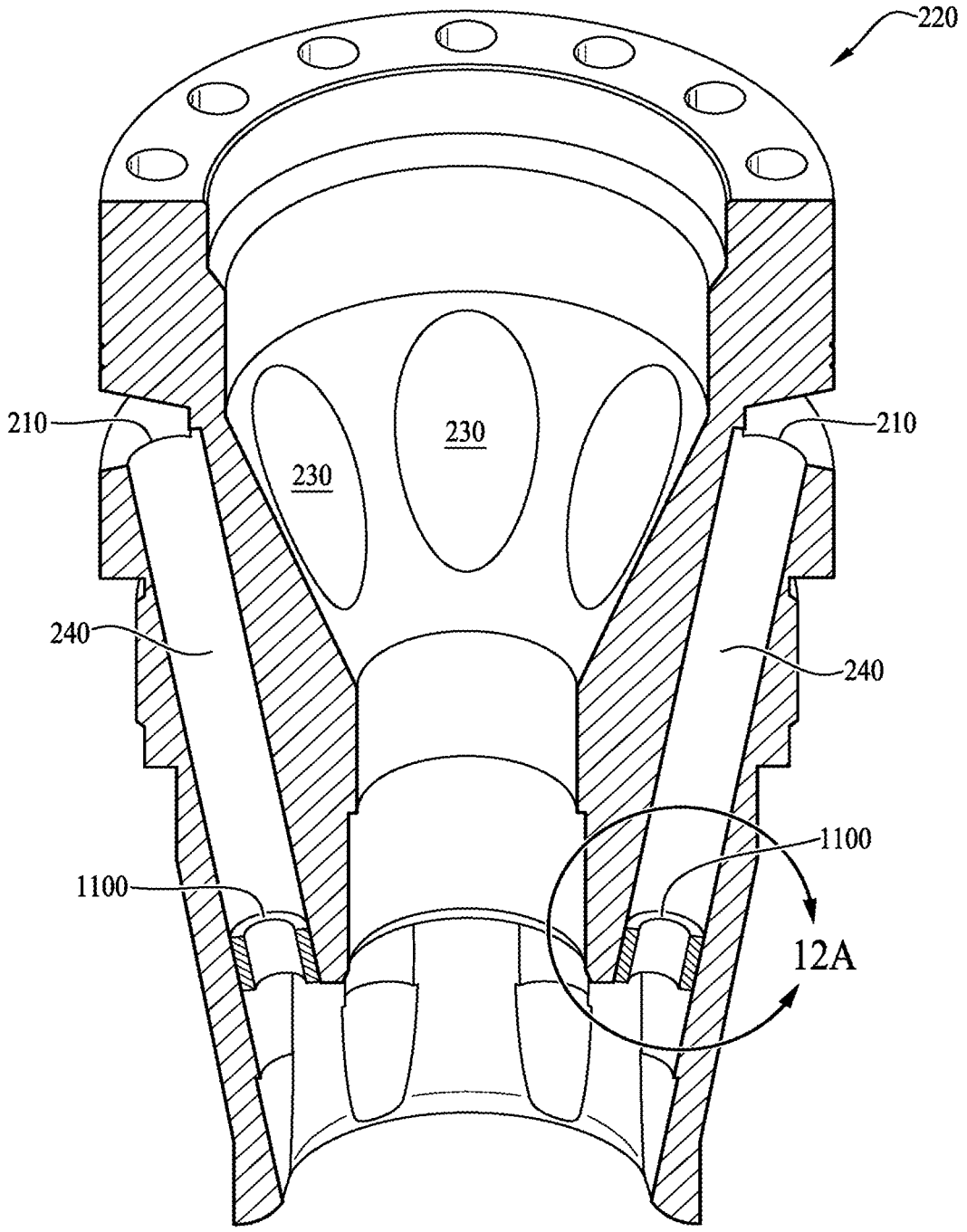
FIG. 11A is a cross-sectional view of an exemplary crossover having flow sizing inserts of an illustrative embodiment in an exemplary vent passage.
Figure 11B:
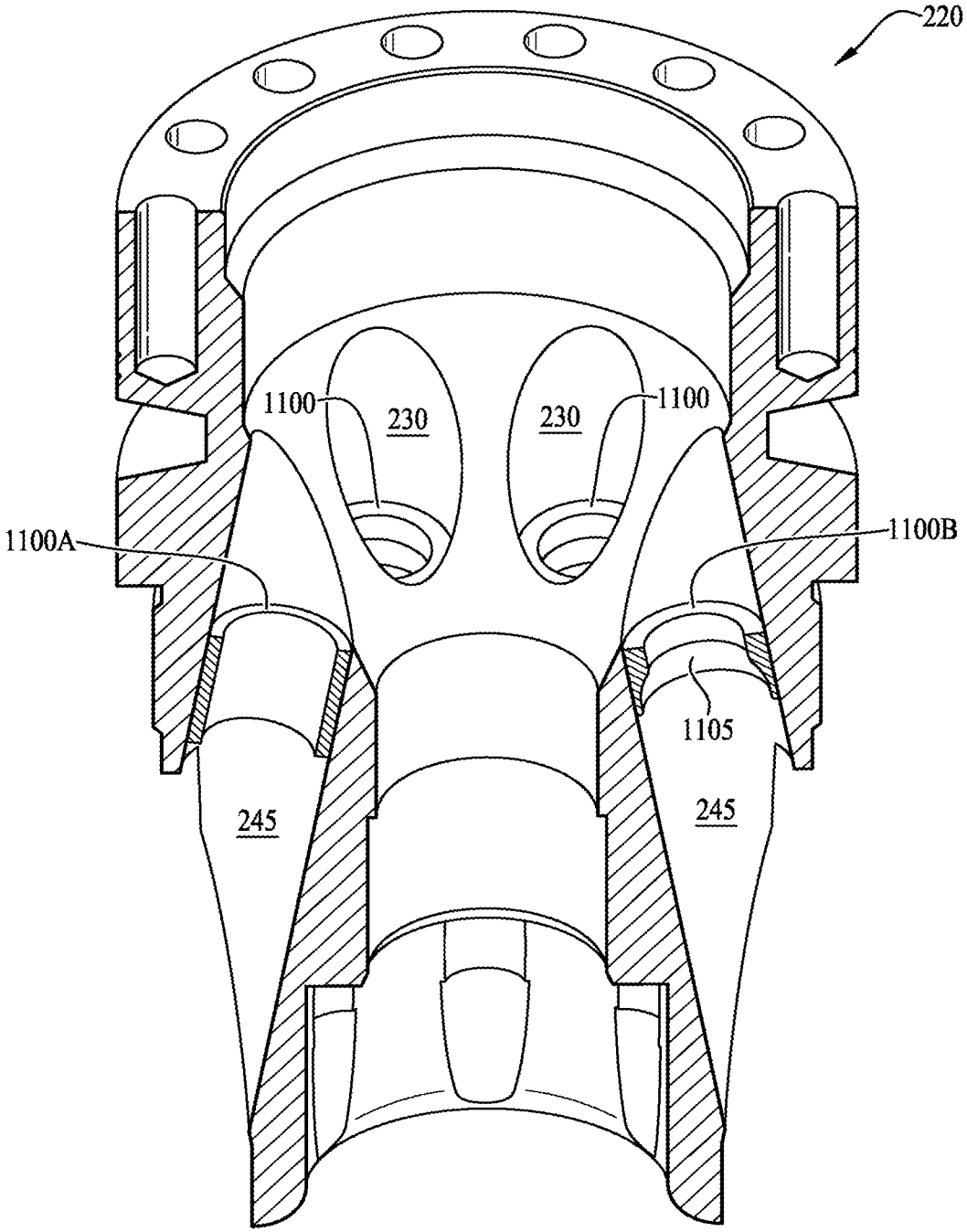
FIG. 11B is a cross-sectional view of a crossover having flow sizing inserts of an illustrative embodiment in an exemplary production passage.

In some embodiments, flow rate harmonization of illustrative embodiments may be accomplished using flow rate modifiers, rather than funnel 400 and/or in addition to funnel 400. In such instances, flow restrictors (flow sizing inserts) may be placed in one or more flow passages of crossover 220 in order to balance and/or harmonize the flow of gas separator 150 and pump 130. FIG. 11A and FIG. 11B illustrate flow sizing inserts of illustrate embodiments. If, for example, gas separator 150 is used with a higher volume pump 130 (such as for example a pump with a flow rate 2,300 bpd or higher, or a pump with 4,000 bpd or higher) where the volume of gas passing through to pump 130 may not need to be controlled as tightly, flow sizing insert 1100 may be placed in vent ports 210 and/or vent passage 240. The flow sizing insert 1110 may at least partially restrict flow through vent passage 240, allowing more fluid to flow through production passage 245 and into pump 130. FIG. 11A illustrates flow sizing inserts 1100 inserted in vent passages 240. On the other hand, if gas control is more of an issue, as with lower flow rate pumps or with radial pumps that are more likely to struggle with gas handling, flow sizing inserts 1100 may be placed in production pathways 245 to reduce the fluid passing to pump 130 and encourage more flow to exit through the vent passages 240. FIG. 11B illustrates flow sizing inserts 1110 inserted in production passages 245 of an illustrative embodiment.

Figure 12A:
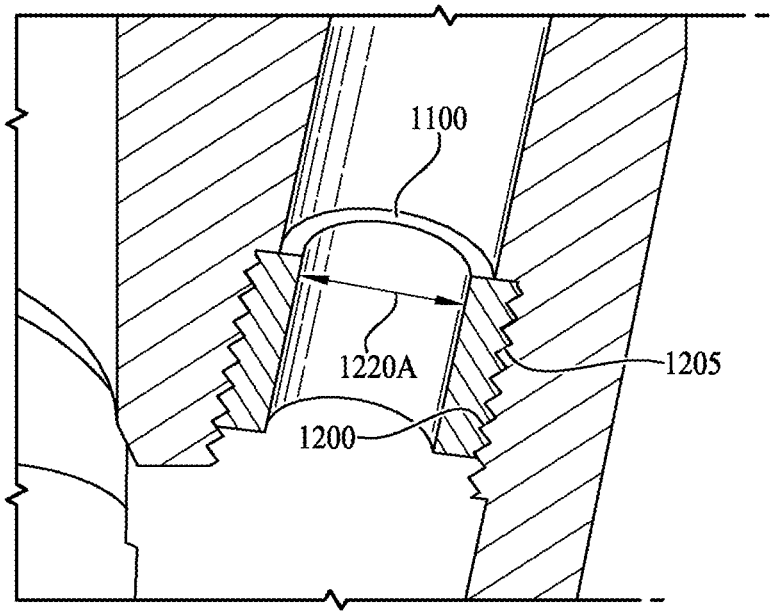
FIG. 12A is an enlarged cross-sectional view of the flow sizing insert of FIG. 11A having a threaded attachment of an illustrative embodiment.
Figure 12B:
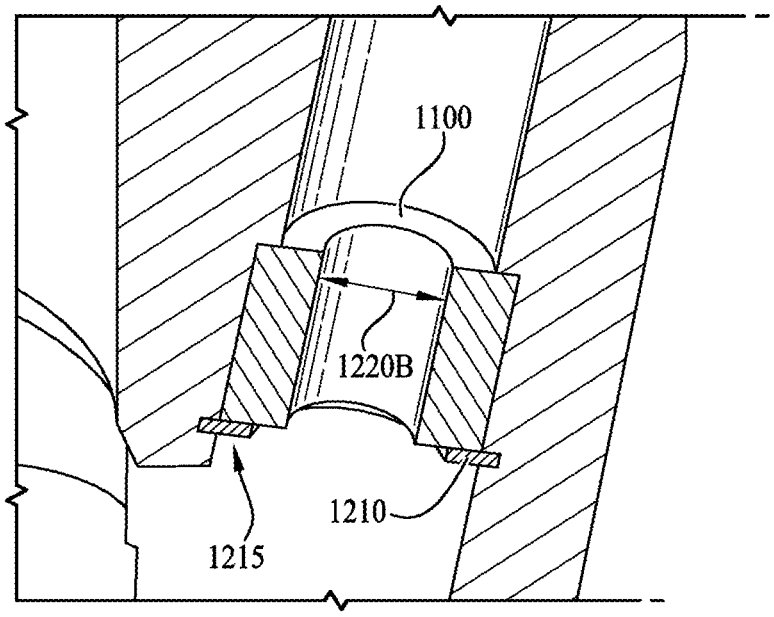
FIG. 12B is a cross-sectional view of a flow sizing insert of an illustrative embodiment having an exemplary snap ring attachment.

Flow sizing inserts 1100 may be made from a variety of different erosion-resistant materials such as tungsten carbide, silicon carbide, titanium carbide or another similar material. Flow sizing inserts 1100 may be inserted into passages 240, 245 from either the bottom (upstream end) of the pathways or from the top (downstream end), depending on several factors including the design of crossover 220, ease of access to the relevant passages 240, 245, length of flow sizing inserts 1100, and/or insert attachment method. Flow sizing insert 1100 may have a simple cylindrical shape as illustrated by exemplary cylindrical flow sizing insert 1100A in FIG. 11B, or may have a nozzle internal profile 1105 as shown by exemplary nozzle flow sizing insert 1100B in FIG. 11B. Nozzle internal profile 1105 may have a diameter that decreases and/or steps inward in a downstream direction, for example as shown in FIG. 11B. In some embodiments, nozzle internal profile 1105 may be shaped similarly to the inner diameter of funnel 400. The inner diameter of flow sizing insert 1100 may be varied based on the extent to which it is desired flow be restricted and flow sizing inserts 1100 may be part of a series similarly to funnel series 600. A comparison between FIG. 12A and FIG. 12B illustrates exemplary cylindrical flow sizing inserts 1100 having distinctly sized inner diameters. As shown, the inner diameter 1220B of flow sizing insert 1100 shown in FIG. 12B is smaller than that of inner diameter 1220A shown in FIG. 12A, and therefore insert 1110 of FIG. 12B is more flow restrictive than that shown in FIG. 12A.

Flow sizing inserts 1100 may be attached and/or secured by a snap ring on one end trapping insert 1100 within a counter bore, threads on the outer diameter of insert 1100 engaging threads on the inner diameter of pathway 240, 245 and/or brazing, epoxying or another similar attachment. FIG. 12A illustrates an exemplary threaded attachment of flow sizing insert 1100. Insert threads 1200 may mate with corresponding passageway threads 1205 to secure flow sizing insert in place within vent passage 240 and/or production passage 245. In another example, a snap ring, retaining ring or another similar attachment may secure insert 1100 within a counter bore. As shown in FIG. 12B, snap ring 1210 secures flow sizing insert 1100 within counter bore 1215.

Illustrative embodiments may provide a gas separator that delivers well fluid to a centrifugal pump with a lower GVF while allowing flow rate harmonization between the gas separator and the attached pump. The one-size fits all gas separator of illustrative embodiments may adapt to pumps with different flow rates, assembly operating conditions, and/or well conditions while delivering an optimum amount of production fluid to the pump and reducing the likelihood of overflow turbulence. Illustrative embodiments include a series of funnels, which may be interchangeably coupled to a crossover of the gas separator and provide distinctive inlet areas that separate fluid being vented to the casing annulus and fluid being sent to the pump. The series of funnels may be interchangeably coupled to the skirt of the crossover in the gas separator of an illustrative embodiment, which may at the wellsite allow simple delivery rate adjustment of fluid to the pump and, as a result, provide flow rate harmonization between the gas separator and pump. In some embodiments, a gas separator may include flow sizing inserts selectively placed within vent passages or production passages of the gas separator to harmonize flow rate between an ESP pump and its attached gas separator.

An apparatus, system and method for flow rate harmonization in electric submersible pump ESP gas separators has been described. Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the scope and range of equivalents as described in the following claims. In addition, it is to be understood that features described herein independently may, in certain embodiments, be combined.

The invention claimed is:

1. A method for flow rate harmonization in electric submersible pump gas separators comprising:

identifying differences between a flow rate of a centrifugal pump and a flow rate of an attached gas separator that serves as an intake of the centrifugal pump;

selecting a funnel having a particularly sized inlet area based on the flow rate difference so identified; and fastening the funnel so selected to a crossover inlet of the attached gas separator, wherein the funnel harmonizes fluids separated by the gas separator by modifying fluid that vents to an annulus casing;

wherein selecting the funnel of the particularly sized inlet area further comprises increasing the particularly sized inlet area dictated by the flow rate difference when gas volume fraction of well fluid in a well where the centrifugal pump is to be deployed exceeds a threshold.

2. The method of claim 1, wherein the funnel has a conical frustum shaped.

3. The method of claim 1, wherein the particularly sized inlet area of the funnel so selected increases as the flow rate difference increases.

4. The method of claim 1, wherein identifying differences between the flow rate of the centrifugal pump and the flow rate of the attached gas separator comprises identifying a best efficiency flow rate of the centrifugal pump and identifying a flow rate of the attached gas separator, and wherein selecting the funnel of the particularly sized inlet area comprises consulting a funnel size selection table.

5. The method of claim 1, further comprising deploying the centrifugal pump and the attached gas separator downhole in a production well.

6. The method of claim 1, further comprising operating the centrifugal pump with the funnel.

7. A method for flow rate harmonization in electric submersible pump gas separators comprising:

determining a flow rate of a gas separator to select a funnel size selection table;

identifying a best efficiency point (BEP) flow rate of a centrifugal pump to be attached to the gas separator;

consulting the funnel size selection table to correlate a funnel size to the BEP flow rate so identified; and attaching a funnel having the correlated funnel size to a skirt of a crossover of the gas separator.

8. The method of claim 7, further comprising deploying the centrifugal pump with gas separator attached downhole in a production well.

9. The method of claim 7, wherein the funnel size selection table correlates a first funnel size to the BEP flow rate when a gas volume fraction of fluid to be pumped by the centrifugal pump is below a threshold, and correlates a second funnel size to the BEP flow rate when the gas volume fraction is above the threshold.

10. The method of claim 7, wherein the funnel is at least partially conical frustum-shaped.

11. The method of claim 7, wherein attaching the funnel to the skirt of the crossover comprises brazing the funnel to the skirt.

12. The method of claim 7, wherein attaching the funnel to the skirt of the gas separator comprises threading the funnel to the skirt.

13. A method for flow rate harmonization in electric submersible pump gas separators comprising:

identifying differences between a flow rate of a centrifugal pump and a flow rate of an attached gas separator;

selecting one of a vent passage or a production passage for flow restriction based on the flow rate difference so identified;

selecting at least one selected from a group comprising a size of an internal diameter and length of a flow sizing insert;

installing flow sizing insert so selected into the one of the vent passage or the production passage so selected; and harmonizing fluids separated by a gas separator by modifying fluid that enters the flow sizing insert;

wherein the flow sizing insert so selected restricts flow through the vent passage or the production passage so selected, the flow restriction dictated by the flow rate difference when gas volume fraction of well fluid in a well where the centrifugal pump is to be deployed exceeds a threshold.

14. The method of claim 13, further comprising operating the centrifugal pump with the installed flow sizing insert.

15. The method of claim 13, further comprising deploying the centrifugal pump and the attached gas separator downhole in a production well.

16. The method of claim 13, wherein identifying differences between the flow rate of the centrifugal pump and the flow rate of the attached gas separator comprises identifying a best efficiency flow rate of the centrifugal pump and identifying a flow rate of the attached gas separator, and wherein selecting the flow sizing insert comprises consulting a flow sizing insert selection table.

17. The method of claim 13, wherein the flow rate difference between the flow rate of the centrifugal pump and the flow rate of the attached gas separator is determined based on a best efficiency flow rate of the centrifugal pump and a flow rate of the attached gas separator.

18. A method for flow rate harmonization in electric submersible pump gas separators comprising:

harmonizing flow of multi-phase well fluid separated by a gas separator by modifying flow of fluid through vent passages of a crossover when a flow rate of a centrifugal pump differs from a flow rate of a gas separator comprising the crossover, the gas separator attached to the centrifugal pump and serving as the fluid intake into the centrifugal pump;

wherein modifying the flow of fluid through the vent passages when a flow rate of the centrifugal pump differs from the flow rate of the gas separator is dictated by a flow rate difference when gas volume fraction of well fluid in a well where the centrifugal pump is to be deployed exceeds a threshold wherein the flow of the fluid through the vent passages is modified by attaching a funnel to a crossover inlet, and the vent passages vent to a casing annulus.

19. The method of claim 18, wherein the flow of the fluid is modified by attaching flow sizing inserts into one of the crossover vent passages or production passages of the crossover, wherein the crossover vent passages fluidly couple to a casing annulus and the production passages fluidly couple to the centrifugal pump.

20. The method of claim 18, further comprising operating the centrifugal pump downhole in a production well.

* * * * *